United States Patent [19]

Biermann et al.

[11] Patent Number: 4,649,367

[45] Date of Patent: Mar. 10, 1987

[54] ELECTRIC POTENTIOMETER

[75] Inventors: Eberhard Biermann, Uhldingen; Heinz Rilling, Eberdingen; Peter Romann, Stuttgart, all of Fed. Rep. of Germany

[73] Assignee: Robert Bosch GmbH, Stuttgart, Fed. Rep. of Germany

[21] Appl. No.: 713,056

[22] Filed: Mar. 18, 1985

[30] Foreign Application Priority Data

May 15, 1984 [DE] Fed. Rep. of Germany ... 8414799[U]

[51] Int. Cl.[4] ..... H01C 1/02; H01C 10/00

[52] U.S. Cl. ..... 338/184; 123/489; 123/494

[58] Field of Search ..... 338/184; 123/494, 489

[56] References Cited

U.S. PATENT DOCUMENTS 3,824,966 7/1974 Schneider et al. ..... 123/494

3,880,125 4/1975 Kammerer et al. ..... 123/494

*Primary Examiner*—Harold Broome

*Assistant Examiner*—M. M. Lateef

*Attorney, Agent, or Firm*—Edwin E. Greigg

[57] ABSTRACT

An electric potentiometer used for conversion of a rotating movement into an electrical value. The potentiometer has a wiper passing across a resistance path and, on the other end, the wiper is rotatingly coupled with a bearing shaft. The resistance path is disposed on a mounting plate next to which is disposed on the intake pipe wall an elongated plug, made of plastic by injection molding, in which are embedded contact prongs, which are connected on the other side in an electrically conducting manner with connecting contacts extending generally perpendicular to the contact prongs.

2 Claims, 4 Drawing Figures

Fig. 3
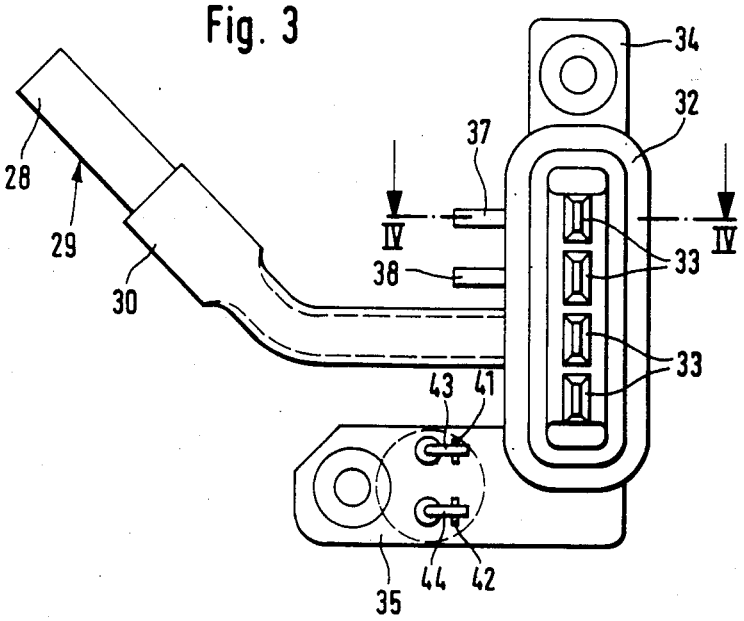
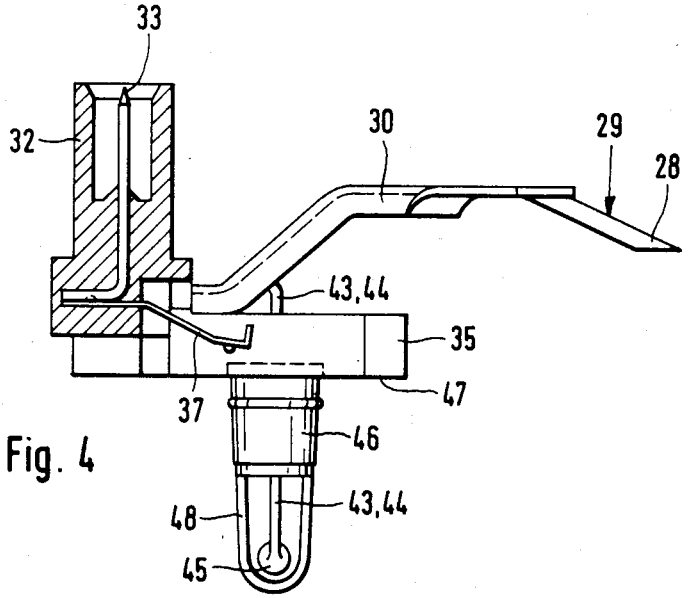
Fig. 4

ELECTRIC POTENTIOMETER

BACKGROUND OF THE INVENTION

The improvement is based on an electric potentiometer. An electric potentiometer is already known (German Pat. No. 22 02 866), in which a flat plug formed as a plastic injection molding piece is fastened to a housing enclosing the potentiometer. The installation of the flat plug on a side of the housing not only requires more complicated assembly, but also results in greater size.

OBJECT AND SUMMARY OF THE INVENTION

In contrast to the foregoing, the electric potentiometer has the advantage of a simple and cheap installation by reason of a simpler assembly and the reduced size required by installation.

By means of the step recited herein, advantageous improvements and advances in the electric potentiometer become possible. By these means the temperature sensor, connected with the prongs of the elongated plug in an electrically conductive manner, can be attached simultaneously with the flat plug to the potentiometer.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the improvement is shown in the drawing in a simplified form and is further described in the ensuing description.

FIG. 3 is a flat plug in accordance with the present invention in an altered scale; and FIG. 4 is a section along line IV—IV of FIG. 3.

DESCRIPTION OF THE PREFERRED EMBODIMENT

Figure 1:
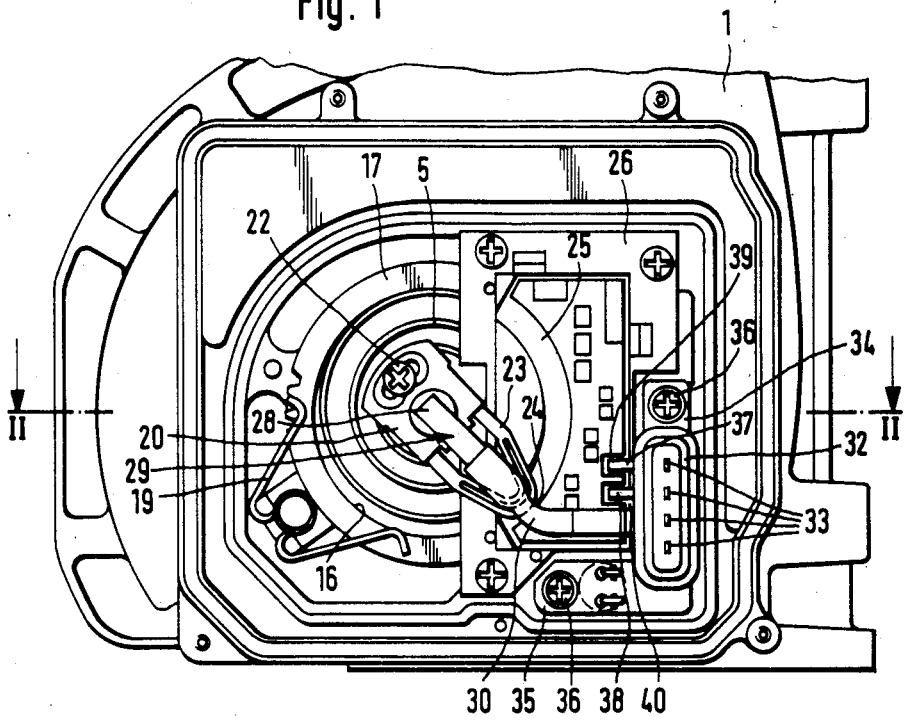
FIG. 1 is a top view of a potentiometer in accordance with the present invention.
Figure 2:
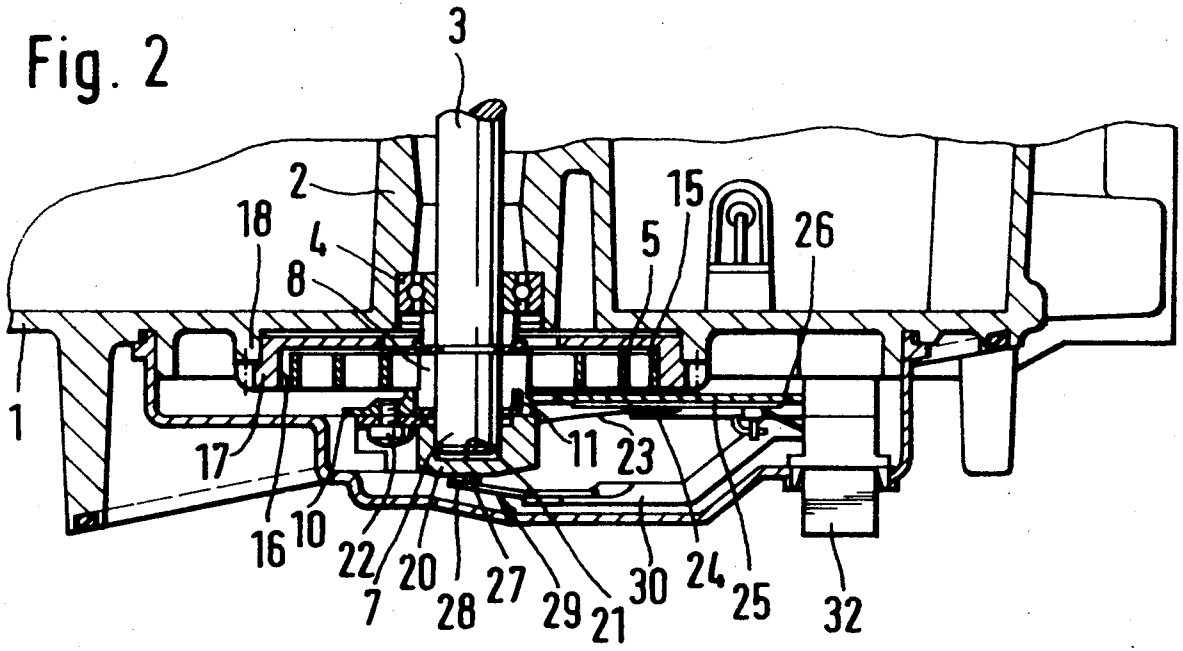
FIG. 2 is a section along line II—II of FIG. 1.

FIGS. 1 and 2 show an electric potentiometer which could be installed on the wall 1 of an intake pipe of an internal combustion engine. A collar 2 is connected with the intake pipe wall 1, which may support a bearing shaft 3 by means of a roller bearing 4 in a rotatable manner. The bearing shaft 3 extends crosswise to the direction of flow of the air taken in by the intake pipe and supports in a known manner an air metering device, for instance in the form of a baffle, which is fixed to the bearing shaft and rotates the bearing shaft against the force of a return spring 5, disposed as a helical spring, to a larger or smaller degree, depending on the flow of the air mass. A support body 8, extruded from plastic, is placed on the bearing shaft end 7 extending from the intake pipe, and a metal fastening sheet 10 with at least one angled tongue 11 is disposed therein. The inner end of the helical spring 5 is fastened on the support body 8, while the outer end 15 is fastened on the wall of a recess 16 of a disk 17, the position of which can be fixed, for instance by a holding spring 19, in an annular section 18 of the intake pipe wall. A support body 20 made from plastic and having a blind bore opening 21 has also been placed on the bearing shaft end 7 and is fastened by means of a screw 22 to the fastening sheet 10, so that the support body 20 rotates with and follows every move of the bearing shaft 3. One end of a wiper 23 is injected into the support body 20, the contact end 24 of which can wipe along a circular resistance path 25 of the potentiometer placed on a mounting plate 26. A contact 27 is connected in an electrically conducting manner with the wiper 23, said contact is fixedly disposed on the support body 20 in the extension of the pivot axis of the bearing shaft 3. The free end 28 of a leaf spring 29 touches the electrical contact 27, said leaf spring is fixed with its other end to a connecting contact 30. The force of pressure of the leaf spring 29 against the contact 27 is easy to adjust and check.

The connecting contact 30 is partially injected into an elongated plug 32, formed by injection molding, at the end away from the leaf spring 29 and is connected in an electrically conducting manner with a prong 33 in the elongated plug. As also shown in FIGS. 3 and 4 in an altered scale, the elongated plug 32 has on one side a connecting flange 34 and on the other side an extension 35, protruding at about right angles to the flat plug. The elongated plug 32 with its connecting flange 34 and the extension 35 is placed on the outside of the intake pipe wall 1 and is connected with the intake pipe wall by means of screws 36, for instance, extending through openings on both the connecting flange and the extension. The elongated plug 32 could, of course, also be mounted on the mounting plate 26. Further connecting contacts 37, 38, are connected in an electrically conducting manner with further prongs 33 of the flat plug 32, and these are also partially embedded in the extrusion molded plastic part of the elongated plug and extend generally perpendicular to the prongs 33, as does the connecting contact 30. When the elongated plug 32 is attached to the intake pipe wall 1 or the mounting plate 26, the connecting contacts 30, 37, 38 assume their working positions, in which the connecting contact 30, together with the leaf spring 29, touches the contact 27 under tension and the connecting contacts 37, 38, touch the contacted points 39, 40. Connecting contacts 41, 42 can extend through the top of the extension 35, at least one of which is connected with the prong 33 and which extend at least partially into the injection molded plastic part. Electrical conductors 43, 44 are each connected with the connecting contacts 41, 42. The conductors 43, 44 are used as electrical conductors for a resistor 45, acting as a temperature sensor, and have been injected into a wiper housing 46, which is disposed on the side 47 of the extension 35 pointing away from the elongated plug 32 and is fastened by such means as, for instance, supersonic welding, gluing, locking or the like. A guard 48, attached to the wiper housing 46, surrounds the temperature sensor 45 at a distance and acts as protection. As the elongated plug is mounted on the intake pipe wall 1, the temperature sensor 45 is simultaneously placed in a position in which it is put in touch with the air in the intake pipe by extending through the wall 1 of the intake pipe. Electrical contact of the temperature sensor 45 with the elongated plug 32 has already been made prior to the mounting on the intake pipe wall 1.

By means of the potentiometer a measured amount of air is transformed into an electrical value, which is, for instance, used to determine the amount of fuel to be injected by the fuel injection apparatus. The disposition of the elongated plug 32 in accordance with the present invention makes possible a direct connection with a reciprocal plug of an electronic control apparatus of the fuel injection apparatus.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electric potentiometer mounted on a wall of an intake pipe of an internal combustion engine, said electrical potentiometer including a resistance path disposed generally parallel to a mounting plate, an elongated plug made as an injection molded plastic part and having equally spaced prongs embedded in said plastic part and electrical connecting contacts, partially embedded in the plastic connected to said prongs, characterized in that said elongated plug is connected with an exterior wall surface of said intake pipe with said prongs extending in an outward direction relative to said intake pipe and the connecting contacts extend generally perpendicularly to said contact prongs.

2. An electrical potentiometer in accordance with claim 1, characterized in that an extension which extends along said wall of said intake pipe is disposed on the injection molded plastic plug and that a temperature sensor is disposed on the extension and inserted through said intake pipe wall into the intake pipe.

* * * * *